United States Patent [19]

Kudlacek

[11] Patent Number: 4,866,810

[45] Date of Patent: Sep. 19, 1989

[54] APPARATUS FOR CLEANING THE NOCK END OF AN ARCHERY ARROW

[76] Inventor: Donald S. Kudlacek, 3412 Oak St., Longview, Wash. 98632

[21] Appl. No.: 233,973

[22] Filed: Aug. 18, 1988

Related U.S. Application Data

[63] Continuation of Ser. No. 514,259, Jul. 15, 1983, abandoned.

[51] Int. Cl.[4] ..... A47L 13/02

[52] U.S. Cl. ..... 15/236.06; 15/104 R; 30/454; 30/455; 51/170 R

[58] Field of Search ..... 15/104.04, 236.06, 105; 30/172, 454, 455, 457, 462; 51/170 R, 172, 204, 205 R, 330

[56] References Cited

U.S. PATENT DOCUMENTS

| | | | |
|---|---|---|---|
| 941,631 | 11/1909 | George | 30/457 |
| 1,026,671 | 5/1912 | Hager et al. | 30/455 X |
| 1,391,080 | 9/1921 | Rundell | 51/204 |
| 1,780,371 | 11/1930 | Benczalski | 145/3.31 |
| 1,810,285 | 6/1931 | Luppert | 145/3.31 |
| 2,499,044 | 2/1950 | Wagg et al. | 273/416 |
| 3,150,398 | 9/1964 | Gage | 15/210 R |
| 3,242,526 | 3/1966 | Wilton et al. | 145/3.7 X |
| 3,250,257 | 5/1966 | Warner | 30/454 |
| 3,769,650 | 11/1973 | Newell | 15/105 |
| 4,305,588 | 12/1981 | Dodge | 273/416 |

*Primary Examiner*—Chris K. Moore

*Attorney, Agent, or Firm*—Olson & Olson

[57] ABSTRACT

An arrow shaft nock end cleaning apparatus includes a body member having a socket in one end arranged to receive the tapered nock end portion of an arrow having its nock removed. A plurality of knurled cleaning pins are disposed circumferentially around the socket and are each arranged to present a working surface disposed angularly relative to the socket axis to closely match the external configuration of a tapered nock end portion of an arrow shaft to be cleaned. An end cap having an arrow shaft-guiding opening is arranged on the open end of the body, the cap opening disposed in alignment with the socket so as to guide an arrow shaft longitudinally thereinto. Rotation of the arrow shaft and body member relative one to the other scrapes the tapered surface of the nock end portion of the arrow shaft against the confronting working surfaces of the knurled cleaning pins, removing unwanted debris therefrom, roughing the surface area of the tapered nock end portion on the shaft, and trueing up the tapered nock end portion of the shaft in preparation of reattaching a replacement nock.

1 Claim, 1 Drawing Sheet

APPARATUS FOR CLEANING THE NOCK END OF AN ARCHERY ARROW

This application is a continuation of application Ser. No. 514,259 filed July 15, 1983 and now abandoned.

BACKGROUND OF THE INVENTION

This invention relates to archery arrows and more particularly to an apparatus arranged to clean and resurface the tapered nock end of an arrow after the arrow nock has been removed and prior to replacement of another nock onto the arrow.

In archery it occurs that an arrow nock occasionally becomes loose or cut and disengages from the arrow during shooting. Since the nock is normally glued on, remnant glue material and pieces of the nock commonly remain adhered to the arrow shaft. These must be removed prior to gluing a new nock back onto the shaft in order to assure a secure bond therebetween.

It has been commonplace heretofore to clean the nock end of the shaft of unwanted remains as well as possible by such methods as scraping, rubbing with solvents or simple manual hand sanding, prior to reattaching another nock. However, such efforts are rather time consuming, inefficient and inaccurate, and it is possible to "overclean" and distort the the symmetrical contour of the tapered end portion of the arrow shaft. Also, cleaning with improper equipment may destroy the particular scoring on the arrow shaft which provides a rough texture for increased glue adhesion.

SUMMARY OF THE INVENTION

In its basic concept, this invention provides an arrow nock-end cleaner arranged to receive the tapered end of an arrow shaft against a knurled cleaning head configured with a working surface disposed at a suitable confronting angle relative to the tapered surface of the arrow, and by relative rotation of the arrow surface and the cleaning head surface, scraping and cleaning of the shaft is obtained.

It is by virtue of the foregoing basic concept that the principal objective of this invention is achieved, namely, the provision of an arrow nock-end cleaner which safely, quickly and effectively cleans undesirable foreign matter from the surface of an arrow shaft nock end prior to installing a new nock.

Another object of this invention is the provision of an arrow nock-end cleaner of the class described which, by virtue of its construction, repairs flat spots, dents and minor cracks in the nock end of an arrow.

A further object of this invention is the provision of an arrow nock-end cleaner of the class described which serves to true the tapered nock-end of an arrow so that a replacement nock may be attached accurately.

Still another object of this invention is the provision of an arrow nock end cleaner of the class described which is arranged to scrape the tapered end of an arrow in a manner in which suitable scoring is made on the tapered portion of the shaft in order to increase the bonding surface of the shaft for increased glue adhesion.

Yet another object of this invention is the provision of an arrow nock-end cleaner of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
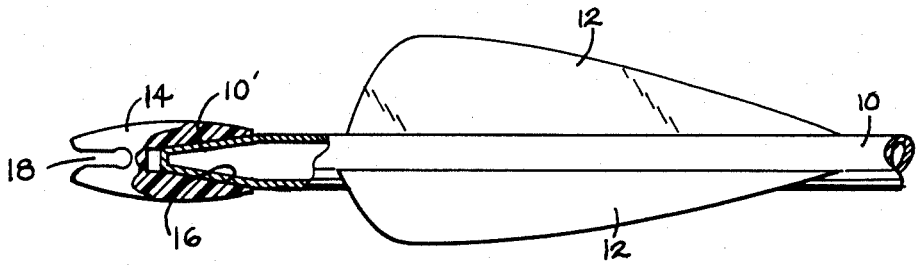
FIG. 1 is a fragmentary side elevation drawn to approximately full scale of the rear portion of an arrow with a conventional plastic nock attached thereto, parts being broken away to disclose internal structural details.

FIG. 1 illustrates a conventional arrow having a hollow tubular shaft 10 which includes a tapered rear nock-end portion 10'. The arrow also usually mounts, as illustrated, three projecting vanes 12 disposed about its circumference which assists the arrow in flight.

A plastic nock 14 is glued to the tapered portion 10' of the arrow shaft. The nock has an interior tapered socket 16 which matches the taper of the shaft portion 10' so as to form a substantially press fit between them. The nock 14 includes a bow string slot 18.

The nock end cleaning apparatus of this invention is illustrated herein as including a body member 20 provided with a tapered, hollow end socket 22. The socket is configured to be greater in longitudinal section than is the longitudinal section of the tapered nock end of an arrow shaft with which it is to be used. Also, it is arranged to extend longitudinally into the body member 20 a distance which is at least great enough to allow the entire tapered nock end portion of the arrow shaft to be contained within it.

Cleaning head means is arranged to engage the tapered nock end surface of an arrow shaft to be cleaned. In the embodiment illustrated, the cleaning head means comprises a plurality of knurled pins 24 which are fitted non-rotatably into angled slots 26 provided at circumferentially spaced intervals in the body 20 about the interior of the tapered socket 22. When so fitted, the exposed knurled working surface of each pin 24 extends angularly into the socket 22 at an angle which precisely matches the correct taper of the nock end portion 10' of an arrow inserted into it, as best illustrated in FIG. 6.

In use, the tapered end 10' of an arrow shaft is pressed into the socket 22 against the working surfaces of the knurled pins 24. The arrow shaft 10 and body 20 are rotated one relative to the other, whereupon the frictional, scraping contact of the tapered nock end portion 10' of the arrow shaft against the knurled surface of the cleaning pins 24 scuffs the surface of the tapered nock end and removes any debris clinging thereto. Continued relative rotation serves to scrape the metal shaft, lightly grinding the shaft and roughing it, putting in desired score lines 28 which increase the surface area of the arrow shaft for increased glue adhesion, or for allowing a new nock to be pressed or screwed on, with or without gluing. If light dents or surface cracks are present in the arrow shaft, the light grinding action of the knurled surfaces removes such flaws or greatly reduces them to acceptable levels quickly and easily. The cleaner also produces a precise angle, presently 11°, of the taper 10', to match the angle of the socket 16. This insures against breakage of the new nock which often occurs when these angles do not match.

Figure 2:
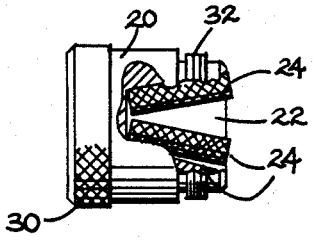
FIG. 2 is a side elevation, drawn to substantially full scale, of an arrow nock-end cleaner embodying the features of this invention, parts being broken away to show internal details.
Figure 3:
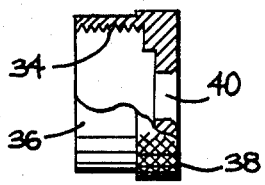
FIG. 3 is a side elevation of a screw-on cap for the cleaner illustrated in FIG. 2.
Figure 4:
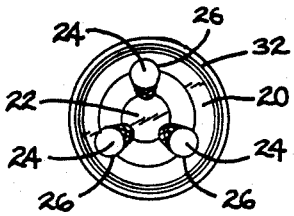
FIG. 4 is an end view of the nock-end cleaner as viewed from the right in FIG. 2.
Figure 5:
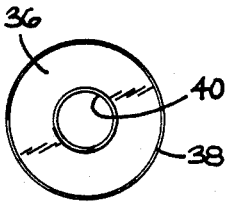
FIG. 5 is an end view of the nock-end cleaner cap as viewed from the right in FIG. 3.
Figure 6:
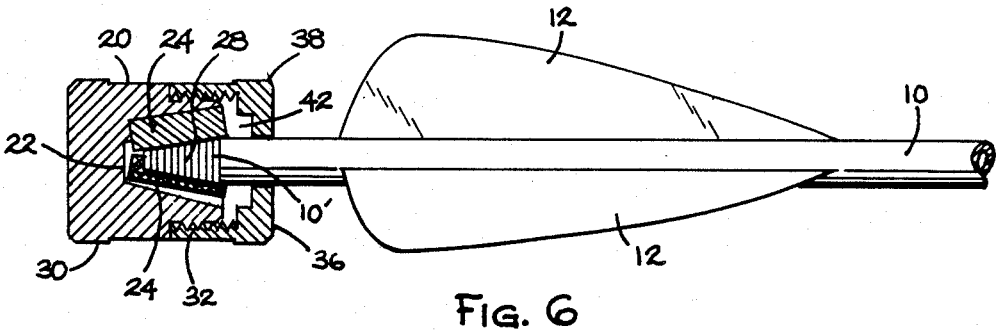
FIG. 6 is a fragmentary side elevation, drawn to substantially full scale, of the nock-end cleaner and an arrow shaft inserted therein, the nock-end cleaner being shown in section to show internal configuration and illustrate its mode of operation.

FIGS. 2 and 6 best illustrate the cleaner body 20 as including a knurled outer end portion 30 to facilitate hand grasping and rotation of the body member. Also, FIGS. 2 and 6 illustrate the body as being provided with external threads 32 adjacent the socket end thereof. The threaded portion is configured to receive the matching internally threaded portion 34 of a hollow screw-on cap member 36 shown in FIGS. 3, 5 and 6. The cap also preferably is provided with a knurled portion 38 arranged for hand grasping. The cap includes a centrally located opening 40 therethrough, the opening being arranged for alignment with the socket 22 of the body 20 when the cap is attached to the body. This opening 40 is configured to be slightly greater in diameter than the diameter of an arrow shaft 10. Accordingly, with the cap threaded onto the body, the opening in the cap provides a guiding bearing surface for the arrow to rotate against and for maintaining the tapered shaft portion 10' in axial alignment with the working surfaces of the cleaning head pins 24.

Aside from its function of guiding the shaft during the cleaning operation described above, the cap also serves the additional beneficial function of providing a container space 42 which receives and holds metal filings and glue remains removed from the arrow shaft, thus preventing the bulk of any debris from simply falling randomly from the cleaner apparatus.

It will be apparent to those skilled in the art that various changes may be made in the size, shape, type, number and arrangement of parts described herein without departing from the spirit of this invention and the scope of the appended claims. For example, as discussed above, the internal body socket 22 is not limited to any particular configuration such as the tapered configuration illustrated, provided that the cleaning head pins 24 are arranged to project into the socket at an angle which corresponds to the taper of the nock end 10' of an arrow shaft.

Also, although the cleaning head means is illustrated herein as comprising three knurled pins spaced circumferentially about and projecting slightly into the socket, any equivalent arrangement of presenting a roughened cleaning surface in the socket for matching, frictional engagement by the tapered nock end portion of an arrow shaft may be utilized. Illustrative of such means may be a socket provided with only one knurled cleaning pin 24, or greater than the three knurled pins illustrated. Alternatively, the socket may be provided with a tapered sleeve having a roughened interior surface which would provide substantially the same confronting work surface as the surface provided by the plurality of knurled cleaning pins 24 illustrated.

Finally, as discussed hereinbefore, the cleaning apparatus of this invention may be operated as described either with or without the end cap 36, as desired.

Having thus described my invention and the manner in which it may be used, I claim:

1. Apparatus for cleaning hardened glue and other debris adhering to the tapered metal nock end portion of an archery arrow shaft having the nock removed therefrom, the cleaning apparatus comprising:

(a) a body member having an open end forming a hollow socket arranged to freely receive the tapered metal nock end portion of an arrow shaft, and (b) a cleaning head including three knurled cylindrical pins secured non-rotatably to and converging inwardly from the open end of the body member, each pin presenting a convex face twowards the center of said socket, said pins being arranged symmetrically at circumferentially spaced intervals in said socket, the nock end-contacting portions of said faces of said pins defining a surface matching the contour of a tapered metal nock end portion of an arrow shaft whereby rotation of the arrow shaft and body member relative one to the other with the adhering hardened glue and other debris contacting said knurled surface effects removal of said glue and other debris from the tapered metal nock end portion of the arrow shaft.

* * * * *